US006032645A

United States Patent [19]

Saiki et al.

[11] Patent Number: 6,032,645

[45] Date of Patent: Mar. 7, 2000

[54] ELECTRONIC FUEL INJECTION APPARATUS FOR DIESEL ENGINE

[75] Inventors: Suzuhiro Saiki; Tadashi Uchiyama, both of Kanagawa, Japan

[73] Assignee: Isuzo Motors Limited, Tokyo, Japan

[21] Appl. No.: 09/256,476

[22] Filed: Feb. 23, 1999

[30] Foreign Application Priority Data

Feb. 24, 1998 [JP] Japan ..... 10-042026

[51] Int. Cl.[7] ..... F02D 31/00

[52] U.S. Cl. ..... 123/357; 123/436

[58] Field of Search ..... 123/357, 358, 123/359, 436

[56] References Cited

U.S. PATENT DOCUMENTS

| | | | |
|---|---|---|---|
| 4,453,516 | 6/1984 | Filsinger | 123/357 |
| 4,502,438 | 3/1985 | Yasuhara | 123/357 |
| 5,293,853 | 3/1994 | Berger | 123/357 |
| 5,299,539 | 4/1994 | Kurihara | 123/357 |
| 5,323,746 | 6/1994 | Best | 123/357 |
| 5,781,876 | 7/1998 | Saur | 123/357 |
| 5,819,705 | 10/1998 | Scherer | 123/357 |

*Primary Examiner*—Carl S. Miller

[57] ABSTRACT

An electronic fuel injection apparatus for a diesel engine comprising a driving state detection means for detecting a driving state of a vehicle associated with an automatic transmission and a controller for periodically determining a target injection quantity based on the driving state. The target injection quantity at a time when a gearshift position is in a driving position is set to a driving target injection quantity which is obtained by adding a predetermined correction quantity to a target injection quantity at a time when the gearshift position is in a non-driving position. When the change of the gearshift position from the non-driving position to the driving position is detected, the target injection quantity is increasingly corrected to the driving target injection quantity.

9 Claims, 4 Drawing Sheets

FIG.1A INJECTION QUANTITY
Qdr_dsr
Qdr_dsr
Qbase
D

GEARSHIFT LEVER SIGNAL
N
D
FIG.1C GEAR ACTION
N

14: INTAKE TEMPERATURE SENSOR
21a: OIL PRESSURE SENSOR
21b: OIL TEMPERATURE SENSOR
27: NEGATIVE PRESSURE CONTROL VALVE

ELECTRONIC FUEL INJECTION APPARATUS FOR DIESEL ENGINE

BACKGROUND OF THE INVENTION

1. Field of the Invention

The present invention relates to an electronic fuel injection apparatus for a diesel engine, and in particular to an electronic fuel injection apparatus for a diesel engine which determines a target injection quantity based on a driving state of a vehicle.

2. Description of the Related Art

In a vehicle comprising an automatic transmission of torque converter type, an engine load is heavier when a gearshift position is in a driving position such as D (drive) position or R (reverse) position than when the gearshift position is in a non-driving position such as N (neutral) position or P (parking) position, so that the rotational speed of the engine slows down.

Therefore, a diesel engine comprising an electronically controlled fuel injection apparatus has a sensor (switch) for detecting the gearshift position of a gearshift lever, where a target injection quantity when the gearshift position is in the driving position is set to a driving target injection quantity (shown by Qdr_dsr of a dotted line in FIG. 1A) which is obtained by adding a predetermined correction quantity corresponding to an amount of such an increased load as mentioned above to a basic target injection quantity (Qbase in FIG. 1A) which is determined based on the driving state such as an engine speed or a load (mainly an accelerator opening), thereby compensating for the slow-down of the engine speed.

It is to be noted that the target injection quantity is to be finally obtained by adding thereto a correction quantity which takes into account parameters such as an intake temperature, water temperature, and intake pressure of the engine.

However, in response to a gearshift lever operation shown in FIG. 1B, the actual gear action, especially from the non-driving position to the driving position causes a delay as shown in FIG. 1C.

This is because the gearshift operation is performed by utilizing the pumping pressure of an oil pump disposed within a transmission to clutch clutch plates, which causes a delay in increasing the pumping pressure.

On the other hand, a sensor for detecting the gearshift position immediately produces a gear action signal in response to the gearshift lever operation. A controller provided within the electronic injection apparatus, in response to the gear action signal, immediately corrects the basic target injection quantity (Qbase) to the above-mentioned driving target injection quantity (Qdr_dsr).

As a result, although the actual gearshift position is not in the driving position, the injection quantity is solely increased, thereby causing an instantaneous rise of engine speed or the generation of smoke at the time of gearshift operation.

In this case, a time lag may also be preset from the time when the gear action signal is received to the time when the injection quantity is corrected in the increasing direction in conformity with the completion timing of the gear action. However, even during the gear action, the load increases for enhancing the pumping pressure of the oil pump as mentioned above, so that the preset time lag may cause the engine speed to slow down.

SUMMARY OF THE INVENTION

It is accordingly an object of the present invention to provide an electronic fuel injection apparatus for a diesel engine comprising a driving state detection means for detecting a driving state of a vehicle associated with an automatic transmission and a controller for periodically determining a target injection quantity based on the driving state, in which an instantaneous rise of engine speed or the generation of smoke at a time of gearshift operation is avoided without a slow down of the engine speed.

For the achievement of the above-mentioned object, an electronic fuel injection apparatus for a diesel engine according to the present invention comprises a gearshift position detecting means for detecting a gearshift position of a gearshift lever, and a controller for setting a target injection quantity at a time when the gearshift position is in a driving position to a driving target injection quantity which is obtained by adding a predetermined correction quantity to a target injection quantity at a time when the gearshift position is in a non-driving position. The controller corrects the target injection quantity increasingly to the driving target injection quantity when a change of the gearshift position from the non-driving position to the driving position is detected.

Namely, the present invention corrects the target injection quantity in the increasing direction gradually (or stepwise) from a target injection quantity Qbase in the non-driving position to a target injection quantity Qdr_dsr in the driving position, as shown by a solid line in FIG. 1A, when the change of the gearshift position from the non-driving position to the driving position is detected by the gearshift position detecting means. This prevents an inconvenience caused by an increase of the injection quantity before the completion of the actual gear action.

A quantity increment rate may be set to correspond to a time lag of the gear action which can be previously and experimentally obtained.

Also, since the above-mentioned time lag of the gear action changes depending on an oil viscosity inside the transmission, it is preferable to detect an oil temperature of the automatic transmission as a substitution parameter for the viscosity and to have the quantity increment rate up to the driving target injection quantity changed so that the rate may be larger when the oil temperature is high than when the oil temperature is low.

Also, the controller may determine an incremental injection quantity by multiplying a difference between the driving target injection quantity and the previous target injection quantity by a predetermined coefficient which changes depending on the detected value of the oil temperature sensor, and may further determine a present target injection quantity by adding the incremental injection quantity to the previous target injection quantity.

Moreover, the driving state detection means may detect a rotational speed and a load or an idling state of the engine as the driving state.

Furthermore, the above-mentioned driving state detection means may comprise at least one of an intake pressure sensor for sensing an intake pressure of an intake pipe, a water temperature sensor for sensing an engine water temperature, and an intake temperature sensor for sensing an intake temperature of the intake pipe.

The electronic fuel injection apparatus for a diesel engine according to the present invention may further comprise an injector actuated by oil pressure or fuel pressure.

Also, the above mentioned controller may correct a pulse width of a command pulse for an electromagnetic valve disposed within an injector in order to control the target injection quantity.

BRIEF DESCRIPTION OF THE DRAWINGS

FIGS. 1A–1C are diagrams illustrating the principle of an electronic fuel injection apparatus for a diesel engine according to the present invention;

Throughout the figures, the same reference numerals indicate identical or corresponding portions.

DESCRIPTION OF THE EMBODIMENTS

Figure 2:
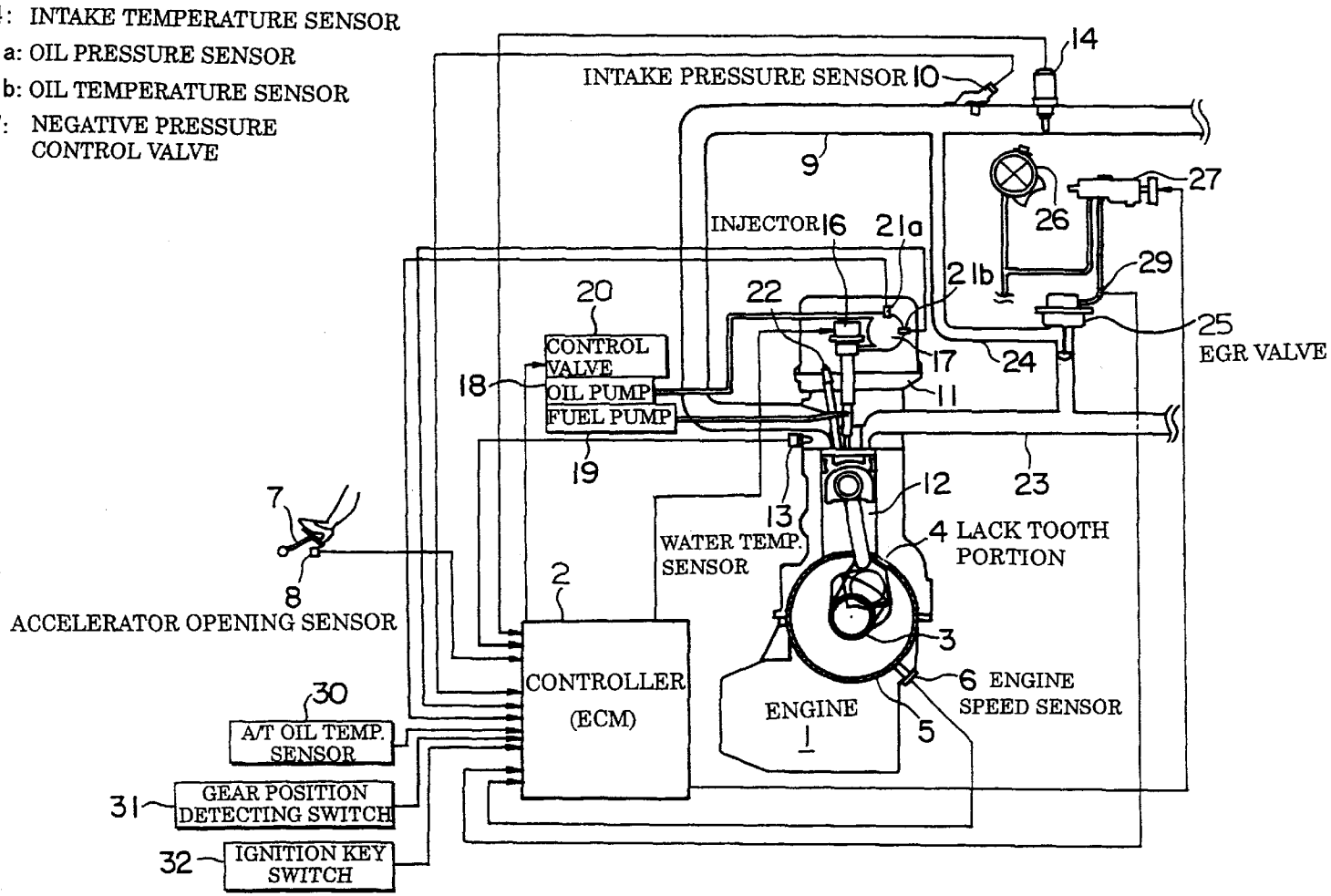
FIG. 2 is a block diagram illustrating an embodiment of an electronic fuel injection apparatus for a diesel engine according to the present invention.

FIG. 2 illustrates an embodiment of an electronic fuel injection apparatus for a diesel engine according to the present invention which is a system comprising a diesel engine 1, a four-cycle four-cylinder direct injection engine as an example, and a controller (ECM) 2 performing a fuel injection control according to output signals of various sensors provided in an intake system, exhaust system, and the like.

Specifically, an engine speed sensor 6 is composed of an electromagnetic pickup so as to be electromagnetically coupled with a regularly toothed wheel 5 having a lack tooth portion 4 which is fixed on a crankshaft 3 of the engine 1, detects a rotational speed (NE) of the engine 1, and gives the speed to the controller 2. Also, an accelerator opening (acceleration) sensor 8 is composed of a potentiometer, detects an operated or step-on quantity (an accelerator opening: ACL) of an accelerator pedal 7, and gives the accelerator opening quantity to the controller 2. The controller 2 changes an analog signal of the accelerator opening into a digital signal to be taken in. At least, the engine speed sensor 6 and the accelerator opening sensor 8 form a driving state detection means.

The driving state detection means preferably comprises sensors such as an intake pressure sensor 10 provided in a position shown in FIG. 2 for sensing an intake pressure of an intake pipe 9, a water temperature sensor 13 provided at a head 11 in an upper part of a cylinder 12 of the engine 1 for sensing an engine water temperature, and an intake temperature sensor 14 for sensing an intake temperature of an intake pipe 9 and is connected to the controller 2.

Also, a hydraulically actuated unit injector 16 is provided at the upper part of the cylinder 12 for fuel to be directly injected into the cylinder 12. To this injector 16 are supplied high-pressure oil from a high-pressure oil pump 18 through an oil rail 17 which is disposed beside the cylinder head 11 and low-pressure fuel from a fuel pump 19. The pressure of the high-pressure oil is controlled by the controller 2 through a control valve (RPCV) 20.

Namely, by supplying fuel of comparatively low pressure to a fuel chamber formed within the injector 16 from the fuel pump 19 and then pressurizing this fuel by a pressurizing plunger (not shown) which is actuated with high-pressure oil from the oil pump 18, the fuel injection is performed at an injection pressure which does not depend on the rotational speed of the engine. It is to be noted that the oil pressure at this time is detected by an oil pressure sensor 21*a,* and the oil temperature is detected by an oil temperature sensor 21*b,* which are fed back to the controller 2.

In the route which supplies the high-pressure oil of the oil pump 18 from the oil rail 17 to the pressured surface of the pressurizing plunger within the injector 16, an electromagnetic valve (not shown) is disposed. The fuel injection is performed by energizing or opening this electromagnetic valve with a control signal from the controller 2.

Namely, the controller 2 determines a duration (a pulse width or a duty ratio) for energizing the above-mentioned electromagnetic valve based on the target injection quantity and controls the fuel injection quantity from the injector 16 by energizing the above-mentioned electromagnetic valve by that pulse width.

It is to be noted that a glow plug 22 serves to assist the engine start.

An EGR (exhaust gas recirculation) pipe 24 is connected from an exhaust pipe 23 to the intake pipe 9 of the engine 1, which makes a part of the exhaust gas feed back to the intake side to reduce the combustion temperature of the engine 1, thereby decreasing a nitrogen oxide. An EGR valve 25 is provided in the middle of the EGR pipe 24. The lift of this EGR valve 25 is controlled by a control valve (EVRV, VSV) 27 which uses a negative pressure provided by a vacuum pump 26 and this lift is detected by a sensor 29 to be given to the controller 2.

Moreover, an oil temperature sensor 30 provided in a position where a hydraulic oil temperature of an automatic transmission (not shown) can be detected, a gear position detecting switch 31 provided in a position where the position of a gearshift lever (not shown) can be detected, and a keyswitch 32 which detects the position of an ignition key are connected to the controller 2.

For more detailed explanations about this fuel injection control system, reference is made to the published Japanese translation No. 6-511526 of PCT international publication for patent applications.

Figure 3:
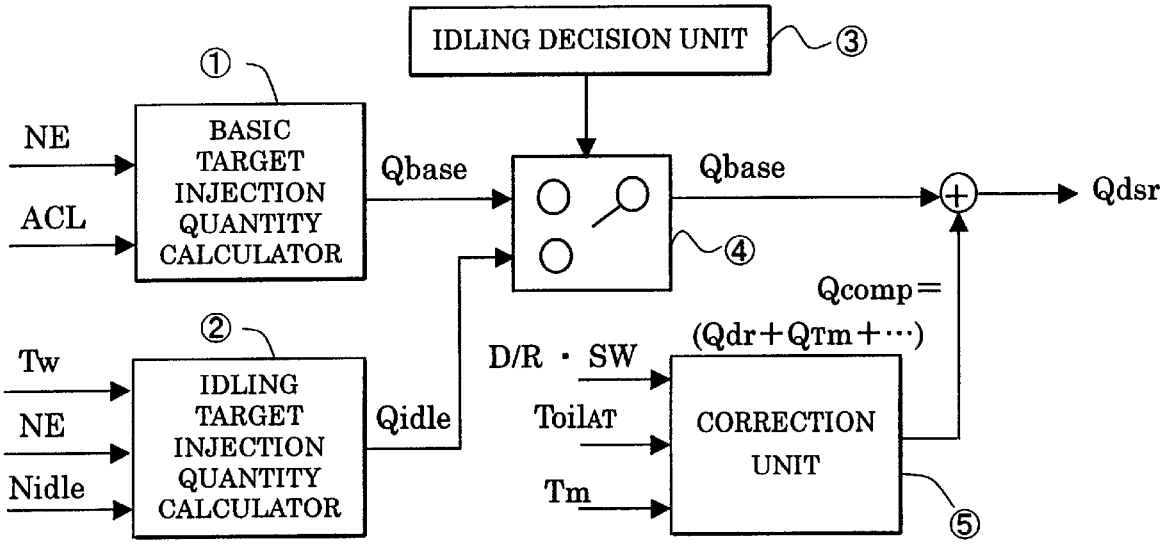
FIG. 3 is a block diagram schematically illustrating an operation of an electronic fuel injection apparatus for a diesel engine according to the present invention.

FIG. 3 illustrates a schematic diagram of a target injection quantity calculation by the controller 2.

First of all, a basic target injection quantity calculator ① calculates a basic target injection quantity Qbase by making reference to a memory map (not shown) from an engine speed NE detected by the engine speed sensor 6 and the accelerator opening ACL detected by the accelerator opening sensor 8.

An idling target injection quantity calculator ② corrects an idling target injection quantity Qfc corresponding to a water temperature Tw detected by the water temperature sensor 13 with a PID control method based on a deviation between the engine speed NE and an idling target engine speed Nidle to obtain an idling target injection quantity Qidle.

An idling decision unit ③ decides the present state to be an idling state when the engine speed NE resides within a predetermined low speed range and the accelerator opening ACL is equal to or smaller than a predetermined small opening (for example, 0%), and otherwise to be a non-idling state.

Then, a switching unit ④ selects the basic target injection quantity Qbase from the calculator ① in case the idling decision unit ③ decides the present state to be the non-idling state and selects the idling target injection quantity Qidle from the calculator ② in case of the idling state. The switching unit ④ outputs the target injection quantity Qbase or Qidle selected in either case, as the basic target injection quantity Qbase.

A correction unit ⑤ determines not only a correction quantity Qdr in a driving position which is characteristic of the present invention but also various correction quantities Qcomp (=Qdr+QTm+ . . . ) such as a correction quantity QTm corresponding to an intake temperature Tm detected by the intake temperature sensor 14 and a correction quantity corresponding to oil pressure and oil temperature detected by the sensors 21*a* and 21*b,* respectively.

By adding (subtracting in some cases) the above-mentioned correction quantity Qcomp to (from) the basic target injection quantity Qbase obtained by the switching unit ④, a final target injection quantity Qdsr as shown in FIG. 1A is determined.

The controller 2 periodically performs the calculation of such a target injection quantity. Moreover, when a crank angle reaches a fixed angle before the fuel injection for each cylinder, the controller 2 determines the pulse width of the electromagnetic valve in the injector 16 based on the above-mentioned final target injection quantity Qdsr by an interruption process.

Figure 4:
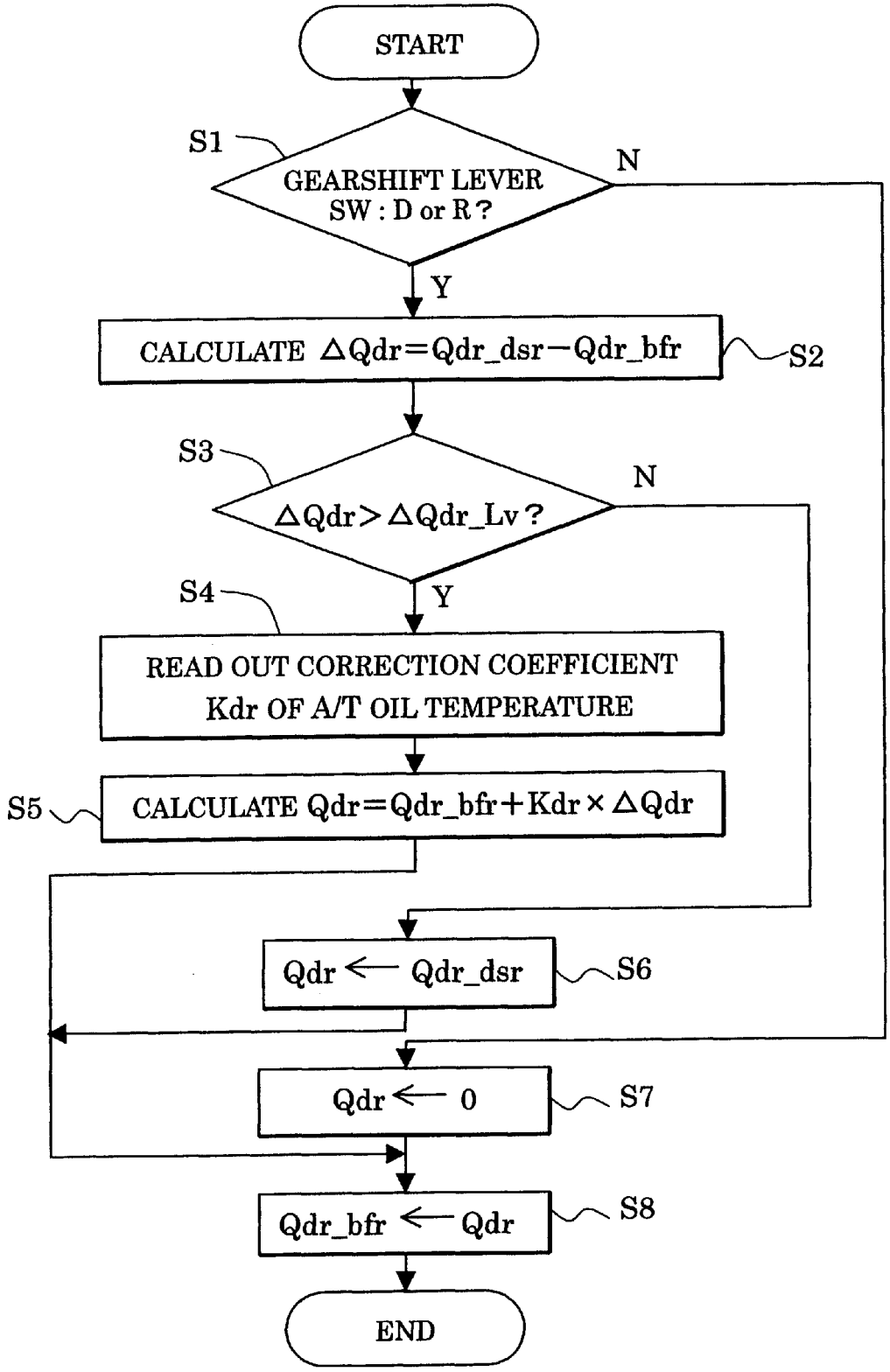
FIG. 4 is a flow chart illustrating a control program executed by a controller used in an electronic fuel injection apparatus for a diesel engine according to the present invention.

FIG. 4 illustrates a flow chart for calculating the driving position correction quantity Qdr which is directly related to the present invention among the correction quantity Qcomp (=Qdr+QTm+ . . . ) which is obtained by the correction unit ⑤ shown in FIG. 3.

Firstly in step S1 of this flow chart, a gear position detecting switch 31 checks whether or not either of the switches corresponding to D (drive) position or R (reverse) position of a gearshift lever (not shown) is made ON. If the answer is "YES", the routine proceeds to step S2.

In step S2, is determined a difference ΔQdr between the driving position correction quantity Qdr_dsr (shown by a dotted line in FIG. 1A) which is predetermined by the controller 2 and the driving position correction quantity Qdr_bfr which is calculated in the last routine. It is to be noted that the initial state is the idling state and therefore the initial driving position correction quantity Qdr_bfr is zero. Accordingly, as shown in FIG. 1A, the correction will be made starting with the basic target injection quantity Qbase.

In step S3, it is determined whether or not the above-mentioned difference ΔQdr is equal to or more than a predetermined quantity ΔQd_Lv, namely whether or not the correction process is nearing the end. If the answer is "YES", the correction is found to be still in process, so that the routine proceeds to step S4.

Figure 1B:
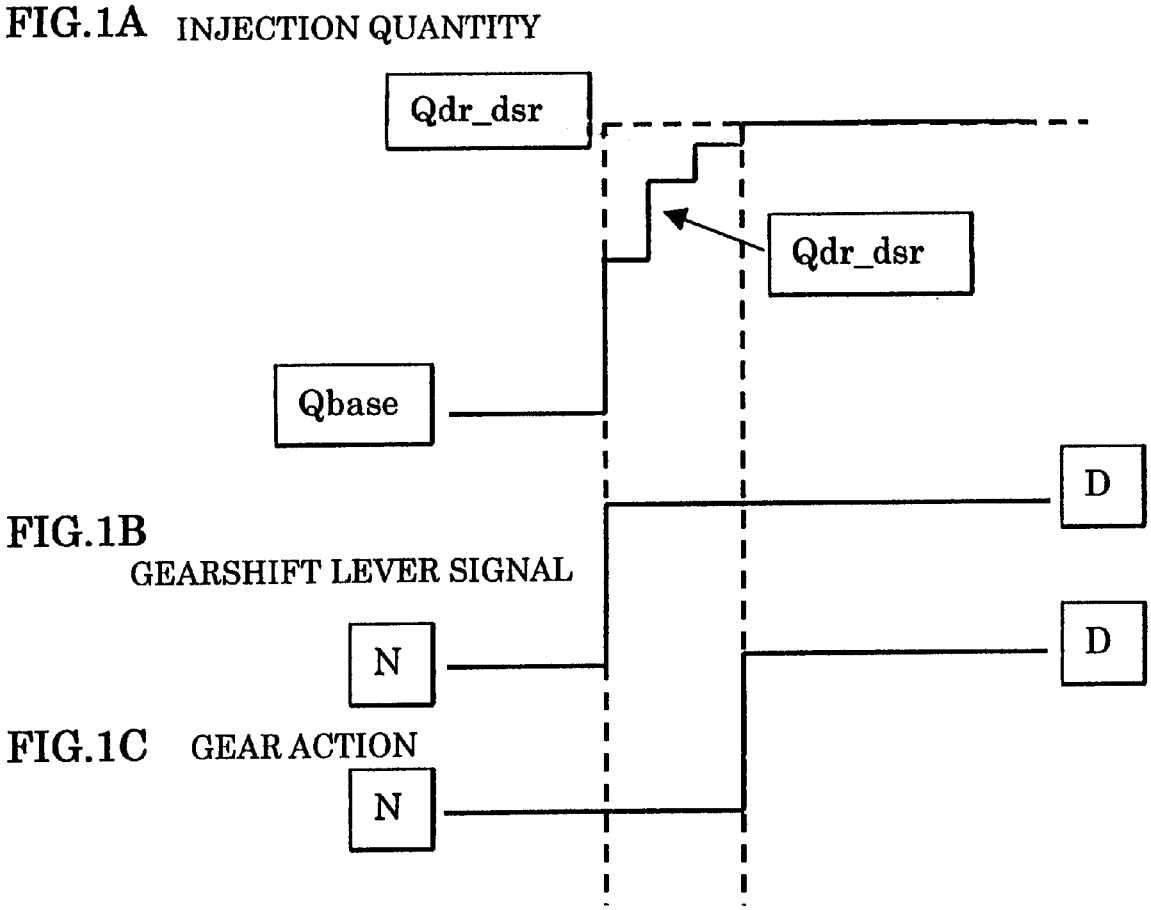

In step S4, depending on a hydraulic oil temperature ToilAT of the automatic transmission which is detected by the oil temperature sensor 30, the controller 2 determines a correction coefficient Kdr by making reference to a prepared map or the like. This coefficient Kdr is preliminarily determined so that the increment rate to the driving target injection quantity Qdr_dsr depending on the hydraulic oil temperature ToilAt may be larger at high oil temperatures than low oil temperatures. This is because the time lag for switching over to the actual gear action from the occurrence of the gearshift operation signal as shown in FIGS. 1B and 1C is longer at low oil temperatures.

Then in step S5, a new driving position correction quantity Qdr is determined by adding an incremental injection quantity calculated by multiplying the above-mentioned difference ΔQdr by the correction coefficient Kdr to the last correction quantity Qdr_bfr.

If it is found in step S3 that the above-mentioned difference ΔQdr is equal to or less than the predetermined quantity ΔQd_Lv, the routine proceeds to step S6 in which the original driving position correction quantity Qdr_dsr is deemed to be a new driving position correction quantity Qdr.

If it is found in step S1 that either of the switches for the D (drive) position or the R (reverse) position is "OFF", the routine proceeds to step S7 in which the driving position correction quantity Qdr is set to "0".

In step S8, the driving position correction quantity Qdr determined by any of the steps S5–S7 is saved as the last correction quantity Qdr_bfr, and the routine ends.

The driving position correction quantity Qdr determined as described above is added, per each calculation of the target injection quantity, to the basic target injection quantity Qbase which is determined based on the engine speed NE, the accelerator opening ACL, and the like, thereby gradually incrementing the final target injection quantity Qdsr for the correction as shown in FIG. 1.

It is to be noted that although the above-mentioned embodiment deals with such a correction control for the target injection quantity, it is needless to say that the pulse width (duty ratio) of a command pulse for the electromagnetic valve within the injector may be corrected.

As described above, the electronic fuel injection apparatus for a diesel engine according to the present invention is so arranged that a target injection quantity at a time when a gearshift position is in a driving position may be set to a driving target injection quantity which is obtained by adding a predetermined correction quantity to the target injection quantity at a time when the gearshift position is in a non-driving position, and when the change of the gearshift position from the non-driving position to the driving position is detected, the target injection quantity may be gradually increased to the driving target injection quantity, thereby avoiding the abnormal rising rate of engine speed and the generation of smoke caused by a delay of actual gear action without requiring timing correction.

What we claim is:

1. An electronic fuel injection apparatus for a diesel engine comprising;

a driving state detection means for detecting a driving state of a vehicle associated with an automatic transmission, a controller for periodically determining a target injection quantity based on the driving state, and a gearshift position detecting means for detecting a gearshift position of a gearshift lever, the controller setting a target injection quantity at a time when the gearshift position is in a driving position to a driving target injection quantity which is obtained by adding a predetermined correction quantity to a target injection quantity at a time when the gearshift position is in a non-driving position, and when a change of the gearshift position from the non-driving position to the driving position is detected, the controller correcting the target injection quantity increasingly to the driving target injection quantity.

2. An electronic fuel injection apparatus for a diesel engine as claimed in claim 1, further comprising an oil temperature sensor for sensing a temperature of a transmission oil of the automatic transmission, the controller determining a quantity increment rate up to the driving target injection quantity corresponding to a value detected by the oil temperature sensor so that the rate may be larger when the oil temperature is high than when the oil temperature is low.

3. An electronic fuel injection apparatus for a diesel engine as claimed in claim 2, wherein the controller determines an incremental injection quantity by multiplying a difference between the driving target injection quantity and the previous target injection quantity by a predetermined coefficient which changes depending on the detected value of the oil temperature sensor, and further determines a present target injection quantity by adding the incremental injection quantity to the previous target injection quantity.

4. An electronic fuel injection apparatus for a diesel engine as claimed in claim 1 wherein the driving state detection means detects a rotational speed and a load of the engine as the driving state.

5. An electronic fuel injection apparatus for a diesel engine as claimed in claim 1 wherein the driving state detection means detects a rotational speed and an idling state of the engine as the driving state.

6. An electronic fuel injection apparatus for a diesel engine as claimed in claim 1 wherein the driving state detection means comprises at least one of an intake pressure sensor for sensing an intake pressure of an intake pipe, a water temperature sensor for sensing an engine water temperature, and an intake temperature sensor for sensing an intake temperature of the intake pipe.

7. An electronic fuel injection apparatus for a diesel engine as claimed in claim 1, further comprising an injector actuated by oil pressure.

8. An electronic fuel injection apparatus for a diesel engine as claimed in claim 1, further comprising an injector actuated by fuel pressure.

9. An electronic fuel injection apparatus for a diesel engine as claimed in claim 1 wherein the controller corrects a pulse width of a command pulse for an electromagnetic valve disposed within an injector in order to control the target injection quantity.

* * * * *